US005857245A

United States Patent [19]

Sakakibara et al.

[11] Patent Number: 5,857,245

[45] Date of Patent: Jan. 12, 1999

[54] MOLDED SURFACE FASTENER WITH CONTINUOUS RIBS ON REAR SURFACE

[75] Inventors: Keisuke Sakakibara; Akira Tomohiro, both of Toyama-ken, Japan

[73] Assignee: YKK Corporation, Tokyo, Japan

[21] Appl. No.: 769,875

[22] Filed: Dec. 19, 1996

[30] Foreign Application Priority Data

Dec. 22, 1995 [JP] Japan ..... 7-335377

[51] Int. Cl.[6] ..... A44B 18/00

[52] U.S. Cl. ..... 24/452; 24/306; 24/444; 24/587; 24/442

[58] Field of Search ..... 24/452, 444, 445, 24/446, 449, 306, 450, 451, 304, 587, 576

[56] References Cited

U.S. PATENT DOCUMENTS

| | | | |
|---|---|---|---|
| 3,732,600 | 5/1973 | Perina | 24/444 |
| 4,890,740 | 1/1990 | Tabler | 206/509 |
| 4,931,344 | 6/1990 | Ogawa et al. | 24/444 |
| 4,933,224 | 6/1990 | Hatch | 24/444 |
| 5,131,119 | 7/1992 | Murasaki et al. | 24/452 |
| 5,179,767 | 1/1993 | Allan | 24/306 |
| 5,211,481 | 5/1993 | Tilman | 24/587 |
| 5,345,659 | 9/1994 | Allan | 24/442 |
| 5,384,942 | 1/1995 | Siegel | 24/587 |
| 5,422,156 | 6/1995 | Billarant | 24/306 |
| 5,500,268 | 3/1996 | Billarant | 24/442 |
| 5,598,610 | 2/1997 | Torigoe et al. | 24/444 |

*Primary Examiner*—Victor N. Sakran
*Attorney, Agent, or Firm*—Hill & Simpson

[57] ABSTRACT

A surface fastener molded of synthetic resin comprises a substrate sheet, a multiplicity of engaging elements standing on a front surface of the substrate sheet, and continuous ribs integrally formed on a rear surface opposite to an engaging surface of the substrate sheet.

3 Claims, 3 Drawing Sheets

MOLDED SURFACE FASTENER WITH CONTINUOUS RIBS ON REAR SURFACE

BACKGROUND OF THE INVENTION

1. Field of the Invention

This invention relates to a surface fastener molded by injection or extrusion and having a substrate sheet and a multiplicity of engaging elements, and more particularly to a molded surface fastener which effectively prevents the substrate sheet from being torn and secures adequate viscosity of a backing glue under various conditions.

2. Description of the Related Art

A surface fastener molded of thermoplastic synthetic resin and having a substrate sheet and a multiplicity of engaging elements standing on a surface of the substrate sheet is already known from U.S. Pat. Nos. 4,725,221, 4,984,339 and 5,131,119.

However, since the substrate sheet of the conventional molded surface fastener has a flat rear surface, a crack would occur in the substrate sheet locally between adjacent rows of engaging elements so that the surface fastener can be easily broken or torn out during sewing.

In the meantime, Japanese Utility Model Publication No. Sho 55-55602 discloses a molded surface fastener in which a woven fiber cloth or a filament film is fused with the substrate sheet, when the substrate sheet is in a melted state, or is attached to the substrate sheet by an adhesive, reinforcing the substrate sheet. But in the surface fastener of such structure, since synthetic resin or adhesive is impregnated into the surface adhering to the woven fiber cloth to make it hard, this reinforced molded surface fastener is not suitable for use in a product that requires adequate softness.

SUMMARY OF THE INVENTION

It is therefore an object of this invention to provide a molded surface fastener in which a substrate sheet has adequate softness and is prevented from being torn and in which adequate viscosity can be secured without being affected by circumferential environment, when a glue is applied to the rear surface for provisionally attaching the surface fastener to a product before sewing, or local hardening can be avoided when the surface fastener is fused to a synthetic resin product by ultrasonic means.

According to this invention, the above object is accomplished by a surface fastener molded synthetic resin, comprising: a substrate sheet; a multiplicity of engaging elements standing on a front surface of the substrate sheet; and continuous ribs of a grid-pattern integrally formed on a rear surface which is opposite to an engaging surface of the substrate sheet.

Preferably, the continuous ribs of the grid-pattern are provided longitudinally and transversely of the substrate sheet, intersecting at right angles one another. Alternatively, the ribs may be provided to extend diagonally with respect to either the longitudinal direction or the transverse direction of the substrate sheet and intersecting one another. In an alternative form, the continuous ribs may be formed continuously on the rear surface of the substrate sheet at positions opposite to spaces between pairs of adjacent engaging elements in the same engaging element rows extending longitudinally of the substrate sheet.

Since the continuous ribs are provided in the grid-pattern, the substrate sheet is prevented from being torn either longitudinally or transversely. If some kinds of suitable glues, selected from various kinds of glues, different in viscosity at a temperature ranging from a high temperature to a low temperature are distributed to predetermined regions inside the gird-pattern, it is possible to keep an adequate degree of viscosity always regardless of variation of temperature. Further, if the molded surface fastener is fused to a synthetic resin product by ultrasonic means, the continuous ribs are fused due to the characteristics of its fusing mechanism and the surface fastener can be kept to be adequately soft without locally hardened.

DETAILED DESCRIPTION OF THE PREFERRED EMBODIMENTS

Preferred embodiments of this invention will now be described in detail with reference to the accompanying drawings.

Figure 1:
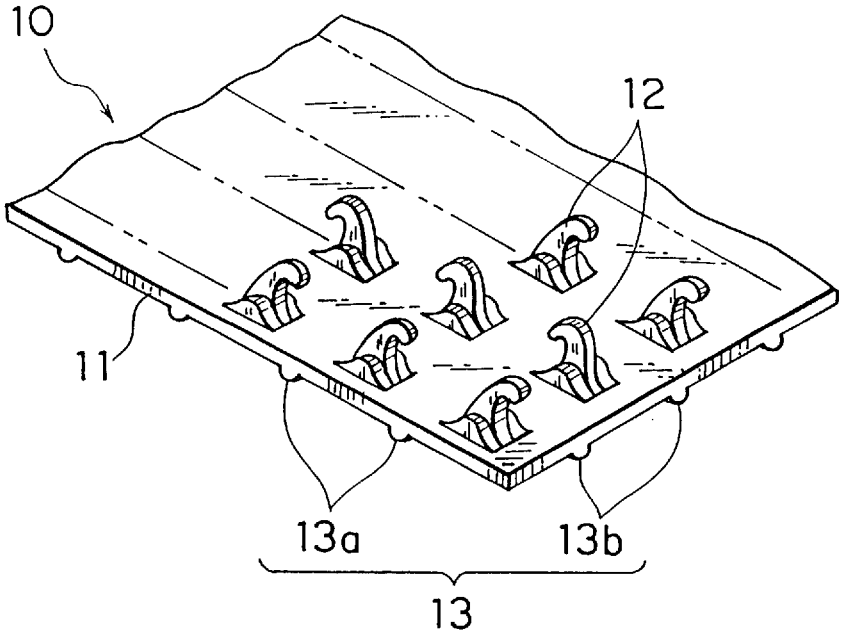
FIG. 1 is a fragmentary perspective view showing a molded surface fastener according to a typical embodiment of this invention.
Figure 2:
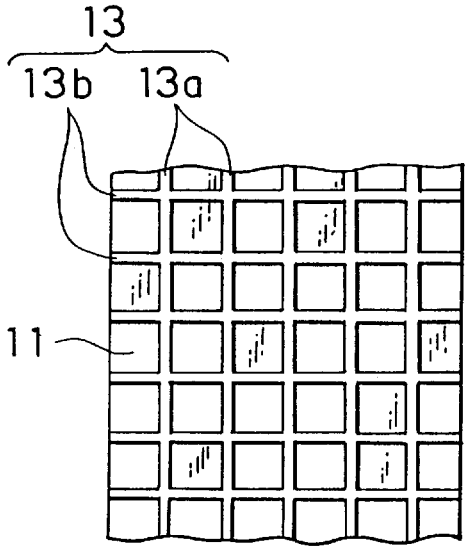
FIG. 2 is a fragmentary bottom plan view of the molded surface fastener.

FIG. 1 is a fragmentary perspective view of a molded surface fastener according to a typical embodiment of this invention, and FIG. 2 is a fragmentary bottom plan view of the molded surface fastener.

Figure 3:
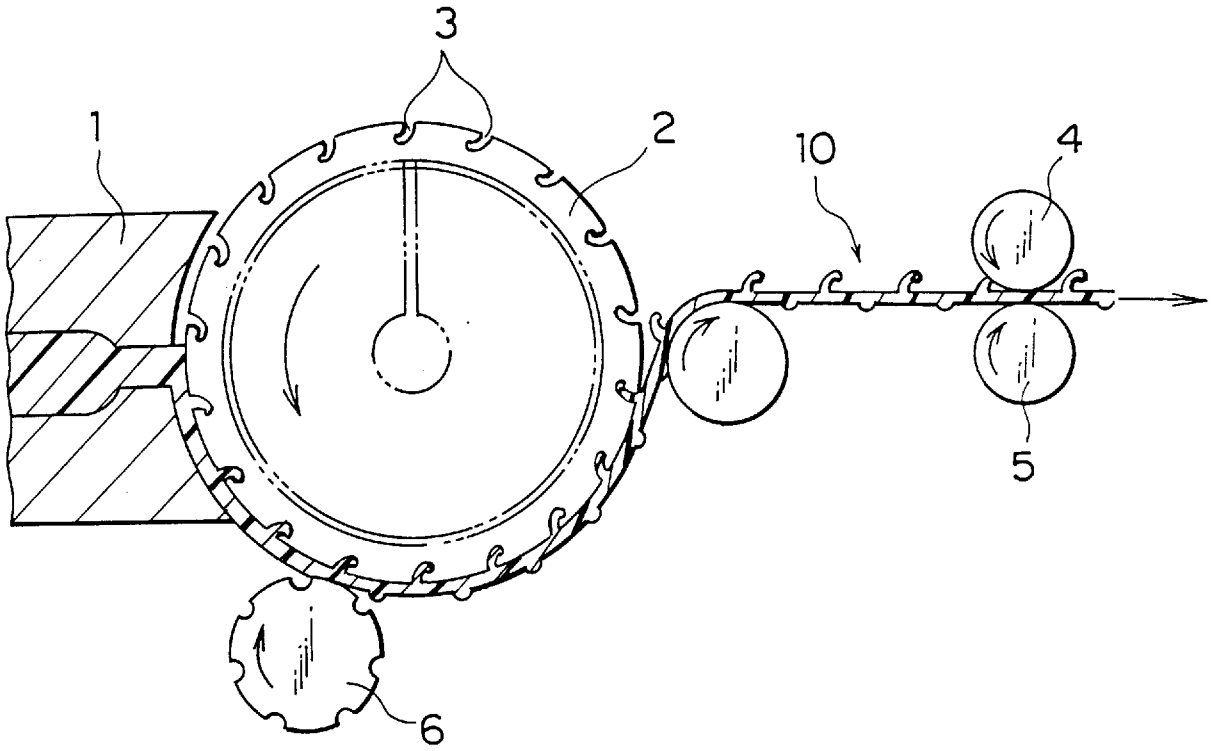
FIG. 3 is a fragmentary cross-sectional view, of a typical apparatus for manufacturing the molded surface fastener.
Figure 4:
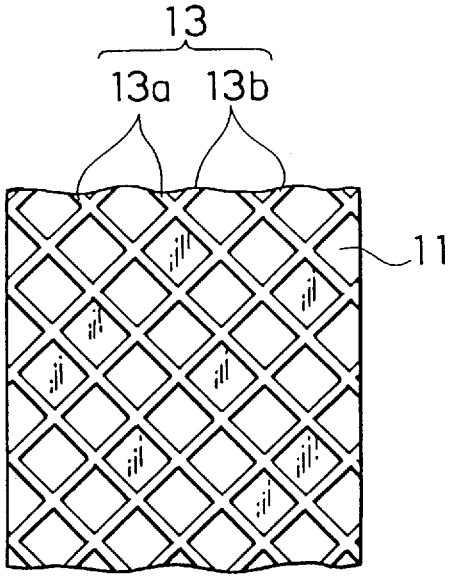
FIG. 4 is a fragmentary bottom plan view of a molded surface fastener according to another embodiment of the invention.

The molded surface fastener of this invention can be continuously manufactured using a conventional apparatus. FIG. 3 is a fragmentary side view schematically showing a molded surface fastener manufacturing apparatus well known in the art. The apparatus may be an apparatus disclosed in International Publication No. WO 87/06522, or the molded surface fastener may be manufactured using a common injection molding machine which comprises a movable die and a fixed die. Further, though engaging elements are exemplified by hooks 12 in the following description, they may be of any other shape, e.g. a mushroom shape or a double-leaf shape.

According to the apparatus of FIG. 3, molten resin is continuously injected to the circumferential surface of a die wheel 2 from an injection nozzle 1 by a predetermined resin pressure. The die wheel 2 is driven for one-way rotation in a direction indicated by an arrow in FIG. 3, during which the molten resin in the form of a substrate sheet 11 attached onto the circumferential surface of the die wheel 2 is moved circumferentially of the die wheel 2 in response to rotation of the die wheel 2. As it is moved round with the die wheel 2, the molten resin is cooled to become solidified. The die wheel 2 has in the circumferential surface a multiplicity of engaging-element-forming cavities 3 for molding hooks 12 as engaging elements of this invention. While the substrate sheet 11 is molded on the circumferential surface of the die wheel 2, part of molten resin is filled in the engaging-element-forming cavities 3 to integrally mold a multiplicity of hooks 12 standing on the substrate sheet 11. A molded surface fastener tape 10 constituted by the substrate sheet 11 and the hooks 12 standing on the substrate sheet 11 is moved circumferentially of the die wheel 2 through a predetermined angle, during which the molded surface fastener tape 10 is cooled and is then removed at a predetermined position from the circumferential surface of the die wheel 2. Then the removed surface fastener tape 10 is conveyed forwardly by tape-up rollers 4, 5.

Figure 5:
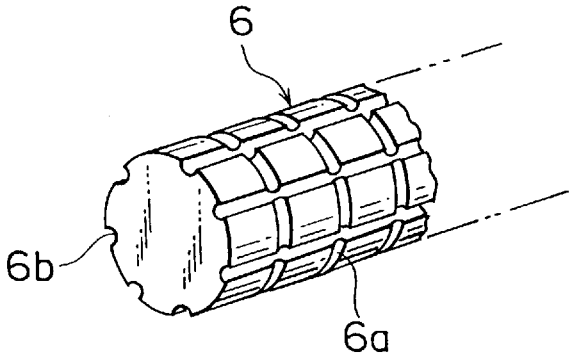
FIG. 5 is a fragmentary perspective view of a rib-forming roller for forming continuous ribs on a rear surface of the molded surface fastener.

In the illustrated example, for molding a characteristic part of the molded surface fastener tape 10 of this invention, a rib-forming roller 6 is disposed in confronting relation to the circumferential surface of the die wheel 2 at a position downstream of a molten resin injecting portion, with its axis being parallel to that of the die wheel 2. The rib-forming roller 6 is rotated in synchronism with the rotation of the die wheel 2. The rib-forming roller 6 is moved toward and away from the circumferential surface of the die wheel 2 by a pressing mechanism, which is composed of a non-illustrated hydraulic cylinder and a linkage, for pressing the substrate sheet 11 on its rear surface with a predetermined pressure. The rib-forming roller 6 has in its circumferential surface a plurality of straight grooves 6*a* extending parallel to the axis and a plurality of straight grooves 6*b* extending around the circumferential surface, as shown in FIG. 5.

With the above-described apparatus for manufacturing the molded surface fastener, in response to the die wheel 2, the rib-forming roller 6 rotates to press the molded and incompletely solidified soft surface fastener 10, which is molded along the rotation of the die wheel 2, on its rear surface (outer surface) to form continuous grid-pattern ribs 13 on the rear surface of the surface fastener 10. The rib-forming roller 6 may be heated so as to form the grid-pattern ribs 13 reliably.

The thus molded surface fastener 10, as shown in FIGS. 1 and 2, has a multiplicity of hooks 12 molded integrally and standing on the front surface of the substrate sheet 11 and continuous ribs 13 of the grid-pattern composed of a plurality of longitudinal straight continuous ribs 13*a* and a plurality of transverse straight continuous ribs 13*b* intersecting at right angles each other. Preferably, the grid-pattern continuous ribs 13 are formed on the rear surface of the substrate sheet 11 at positions opposite to spaces between pairs of adjacent hooks 12, which are disposed on the front surface of the substrate sheet 11, longitudinally or transversely. Particularly, it is most preferable that, at least, the transverse continuous ribs 13*b* are provided on the rear surface of the substrate sheet 11 at positions opposite to the spaces between adjacent hooks in each of rows extending longitudinally of the substrate sheet 11.

According to the molded surface fastener 10, since the grid-pattern ribs 13 are integrally molded on the rear surface of the substrate sheet 11, which is smaller in thickness than conventional, the substrate sheet 11 is prevented from being torn especially along a sewing line, where a crack is most apt to occur, while the surface fastener 10 is sewn to a woven fiber cloth or a fiber-reinforced synthetic resin sheet. It is a common practice to apply a glue to the rear surface of the surface fastener 10 so that the surface fastener 10 would not move on a companion product during sewing. A glue would be most viscous at an optimum temperature depending on the substance and composition; if the rear surface of the molded surface fastener is flat as conventional, it is necessary to select a suitable glue to meet the circumferential environment such as temperature at the working site.

Since the molded surface fastener 10 has on its rear surface the grid-pattern ribs 13, it is possible to secure excellent viscosity in a wide range of temperature if various kinds of glues displaying different viscosity properties depending on changes of the temperature are applied to the rear surface of the surface fastener 10 at desired grids framed by the grid-pattern ribs 13, so that the best viscosity is always guaranteed.

If the product to which the molded surface fastener 10 is to be attached is a synthetic resin plate, usually the surface fastener 10 is fused with the product by ultrasonic means. In such case, if the entire area of the rear surface of the surface fastener is intended to be fused, the substrate sheet 11 has weak portions generally to be rigid and weak. However, in the molded surface fastener 10 of the invention, since the pressure is centralized upon the ribs on the rear surface, not only the attaching strength of the ribs is improved, but also the entire substrate sheet 11 is prevented from being torn or otherwise broken.

In the foregoing embodiment, the longitudinal and transverse straight continuous ribs 13*a*, 13*b* of the grid-pattern continuous ribs 13 intersect at right angles. Alternatively, the grid-pattern ribs 13 may be formed to extend diagonally at a predetermined angle with respect to either the longitudinal direction or the transverse direction of the substrate sheet 11 and intersecting one another.

As is understood from the foregoing description, according to the molded surface fastener of this invention, since the plurality of continuous ribs are formed to extend straight on the rear surface of the substrate sheet 11, the substrate sheet 11 is free from any tear or crack at spaces between adjacent engaging elements. For example, it is possible to effectively prevent the surface fastener 10 from being torn along a sewing line while the surface fastener 10 is sewn to a product. Further, as the continuous ribs 13 are formed in the grid-pattern, it is possible to secure excellent viscosity in any circumferential environment if various kinds of glues displaying different viscosity properties are applied to the rear surface of the surface fastener at desired areas framed by the grid-pattern ribs 13, so that the surface fastener 10 can be temporarily attached to the companion product effectively. Furthermore, in the case where the molded surface fastener 10 is fused with a synthetic resin product by the ultrasonic means, partly since the ribs 13 are effectively pressed against the companion product to which the surface fastener 10 is to be attached, and partly since the pressed portions of the ribs 13 are fused with the product most, it is possible to attach the surface fastener to the product firmly with minimum energy and to maintain the surface fastener 10 adequately soft without making remaining portions hardened. Accordingly this invention is particularly useful when embodied in a modern molded surface fastener having a thin substrate sheet and very-small-size engaging elements.

Each of the continuous ribs 13*a*, 13*b* is not limited to be straight, and it may be curved.

What is claimed is:

1. A surface fastener of a molded synthetic resin, comprising:

(a) a substrate sheet;

(b) a multiplicity of engaging elements standing on an engaging surface of said substrate sheet; and (c) continuous ribs extending and integrally formed on a rear surface opposite said engaging surface of said substrate sheet, wherein said continuous ribs are in a grid-pattern disposed to extend longitudinally and transversely, intersecting at right angles relative to one another.

2. A surface fastener of a molded synthetic resin, comprising:

(a) a substrate sheet;

(b) a multiplicity of engaging elements standing on an engaging surface of said substrate sheet; and (c) continuous ribs extending and integrally formed on a rear surface opposite said engaging surface of said substrate sheet, wherein said continuous ribs are in a grid-pattern extending diagonally with respect to a longitudinal and a transverse direction relative to said substrate sheet and intersecting one another.

3. A surface fastener of a molded synthetic resin, comprising:

(a) a substrate sheet;

(b) a multiplicity of engaging elements standing on an engaging surface of said substrate sheet; and (c) continuous ribs extending and integrally formed on a rear surface opposite said engaging surface of said substrate sheet, wherein each of said continuous ribs extends on said rear surface of said substrate sheet at positions opposite to spaces between pairs of adjacent of said engaging elements in rows extending longitudinally of said substrate sheet.

* * * * *